United States Patent [19]

Elliott

[11] Patent Number: 4,967,419

[45] Date of Patent: Nov. 6, 1990

[54] ARM PROTECTOR

[76] Inventor: Grady N. Elliott, 7813 Fairbluff Dr., Lewisville, N.C. 27023

[21] Appl. No.: 421,321

[22] Filed: Oct. 13, 1989

[51] Int. Cl.[5] ..... A41D 19/00

[52] U.S. Cl. ..... 2/16; 2/161 R; 2/167

[58] Field of Search ..... 2/16, 167, 161 R

[56] References Cited

U.S. PATENT DOCUMENTS

| | | | |
|---|---|---|---|
| D. 290,766 | 7/1987 | Pierce, Jr. . | |
| D. 299,562 | 1/1989 | Lee . | |
| 925,952 | 6/1909 | Sacks . | |
| 1,141,656 | 6/1915 | Rosenbaum et al. . | |
| 1,929,385 | 10/1933 | Jensen | 2/161 R |
| 2,561,891 | 7/1951 | Tucker | 2/167 X |
| 2,710,971 | 6/1955 | Hall | 2/161 R |
| 3,189,919 | 6/1965 | Chase . | |
| 3,391,406 | 7/1968 | Lucas | 2/161 R |
| 4,004,295 | 1/1977 | Byrnes, Sr. | 2/161 R |
| 4,384,449 | 5/1983 | Byrnes, Sr. et al. | 2/161 R X |
| 4,750,218 | 6/1988 | Ziegler | 2/167 X |
| 4,785,478 | 11/1988 | Mosley | 2/167 X |

FOREIGN PATENT DOCUMENTS

| | | | |
|---|---|---|---|
| 0913015 | 11/1960 | United Kingdom | 2/161 R |

*Primary Examiner*—Daniel M. Yasich

[57] ABSTRACT

An arm protector for mechanics or other workers is provided which is relatively lightweight and comfortable during prolonged wear. The tubular sleeve-like device covers the hand and arm and includes a knitted metallic outer layer for protection against burns or other injuries as may occur with inadvertent contact with a engine manifold or other heated objects. The fingers are positioned through apertures in the distal end of the protector thus preventing any loss of manual dexterity by the user.

11 Claims, 2 Drawing Sheets

ARM PROTECTOR

BACKGROUND OF THE INVENTION

1. Field Of The Invention

The invention herein pertains to devices to prevent arm injuries of a worker such as a mechanic who frequently comes into contact with hot metallic engine parts or the like. The device can be comfortably worn without any loss of dexterity or arm movement.

2. Description Of The Prior Art And Objectives Of The Invention

Several types of arm protectors have been developed in the past such as seen in U.S. Pat. No. 3,189,919 and Des. Patent 290,766. Such prior art concepts are helpful in protecting the arm from sport or impact injuries but afford little protection against heated metal surfaces such as engine manifolds which are frequently encountered by vehicle mechanics in their routine duties. Also, prior art arm protectors neither afford a shield against heated surfaces nor do they protect the palm of the hand as most such protectors are concerned with protecting the arm from the wrist to the forearm.

Thus, with the known disadvantages and problems associated with prior art protection devices, the present invention was conceived and one of its objectives is to provide a comfortable sleeve-like device which will protect the entire arm of the wearer.

It is another objective of the present invention to provide an arm protector which will completely surround the arm and hand from the fingers to the shoulder of the wearer to afford total arm protection by completely encircling the arm and hand with a laminated construction.

It is still another objective of the present invention to provide an arm protector which will allow the wearer to maintain his manual dexterity by having finger apertures so the fingers are not encumbered when wearing the protective device.

It is also an objective of the present invention to provide an arm protector which is formed from a plurality of knitted layers with the outer layer formed from metallic yarn and the inner layers formed from conventional cotton yarn.

Various other objectives and advantages of the present invention become apparent to those skilled in the art as a more detailed description of the invention is presented below.

SUMMARY OF THE INVENTION

The aforesaid and other objectives are provided by an arm protector which is formed from a knitted cotton inner layer, an knitted cotton intermediate layer and an outer layer knitted from a conventional heat resistant metallic yarn. During wearing the protector extends from the fingers to the shoulder of the wearer and totally enwraps the arm providing protection to the back and palm of the hand, and other parts of the arm including the wrist, forearm and upper arm. A large entry opening at the proximal end of the sleeve-like device is formed with resilient threads or with an elastic band to hold the device firmly in place while being worn. The knitted construction allows the arm to "breathe" and the metallic outer layer prevents the wearer's arm from being burned by heated objects such as an engine housing or the like. A series of finger apertures are formed at the distal end of the device so a mechanic for example, may work with his usual skill and dexterity while protecting his arm from burns, nicks, bruises, cuts or other injuries.

DESCRIPTION OF THE PREFERRED EMBODIMENT

Figure 1:
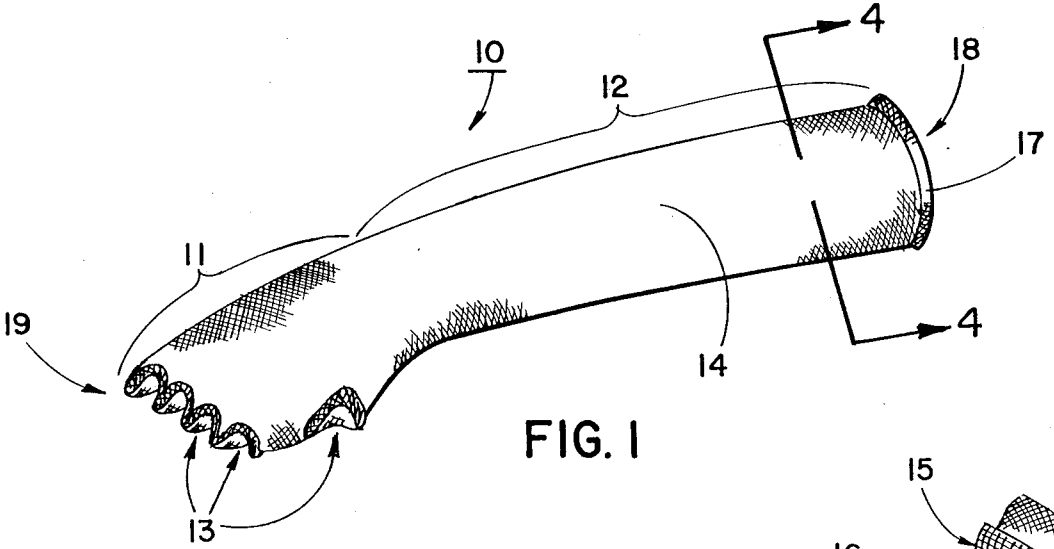
FIG. 1 shows in perspective view a sleeve-like arm protector as would be worn on the right arm.

The preferred form of the invention as shown in FIG. 1 comprises a sleeve-like device which is placed over the arm of the wearer and extends from the fingers to the shoulder. The device completely encircles the hand and arm, for protection of the palm and other parts of the hand, wrist, forearm and upper arm. Knitted cotton fabric is used in constructing the inner layer and the intermediate layer. The outer layer is knitted with a heat resistant metallic thread to provide a heat resistant outer surface. An elastic band is placed around the opening at the proximal end of the device whereby the proximal end will stay in place during use by the wearer. The knitted construction allows the arm to breathe and the device can be worn by a mechanic on both arms during a normal eight (8) hour shift without discomfort or interference with normal work activities.

DETAILED DESCRIPTION OF THE DRAWINGS AND OPERATION OF THE INVENTION

Figure 4:
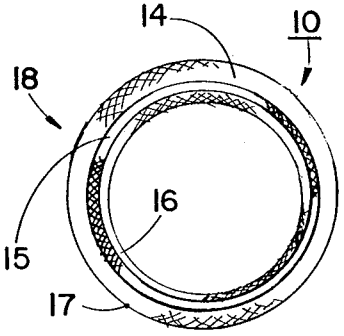
FIG. 4 illustrates a view of the open device along lines 4—4 of FIG. 1.

Mechanics and other skilled tradesmen oftentimes have to work under unfavorable or dangerous conditions. Repairmen frequently must work in confined areas with hazardous, heated or cooled fluid containing pipes nearby. Inadvertent contact with a highly heated pipe or other object will oftentimes burn the arm or hand of the worker resulting in a disabling injury. To remedy this situation and provide the worker with a comfortable safety device, arm protector 10 has been developed as shown in FIG. 1 which comprises a flexible sleeve-like device in the form of a multi-layered knitted tube. Protector 10 has a hand portion identified approximately at 11 and arm portion identified approximately at 12. Hand portion 11 includes a series of finger apertures 13 and as would be understood portion 11 completely covers the back and palm of the hand to the fingers. Device 10 as shown in FIG. 1 can be worn on-the right arm or can be turned over and worn on the left arm since the same arm protector 10 can be worn on either arm. Elastic band 17 is provided at the proximal end 18 of arm protector 10. Band 17 may incorporate "knitted in" elastic yarns or may include an elastic band or strap which is sewn into the end into proximal end 18 as seen in FIG. 4.

Figure 3:
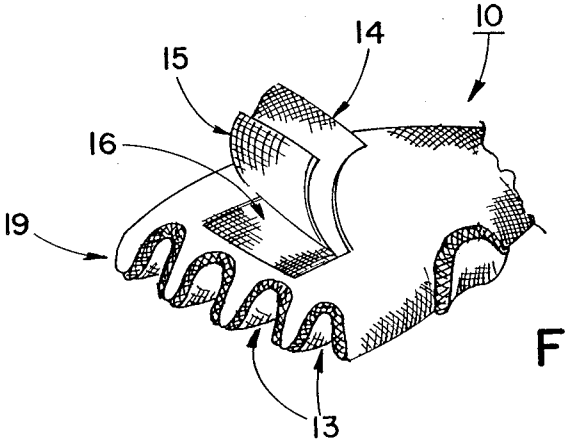
FIG. 3 illustrates in close up fashion the layered construction of a section of the device as shown in FIG. 1.
Figure 2:
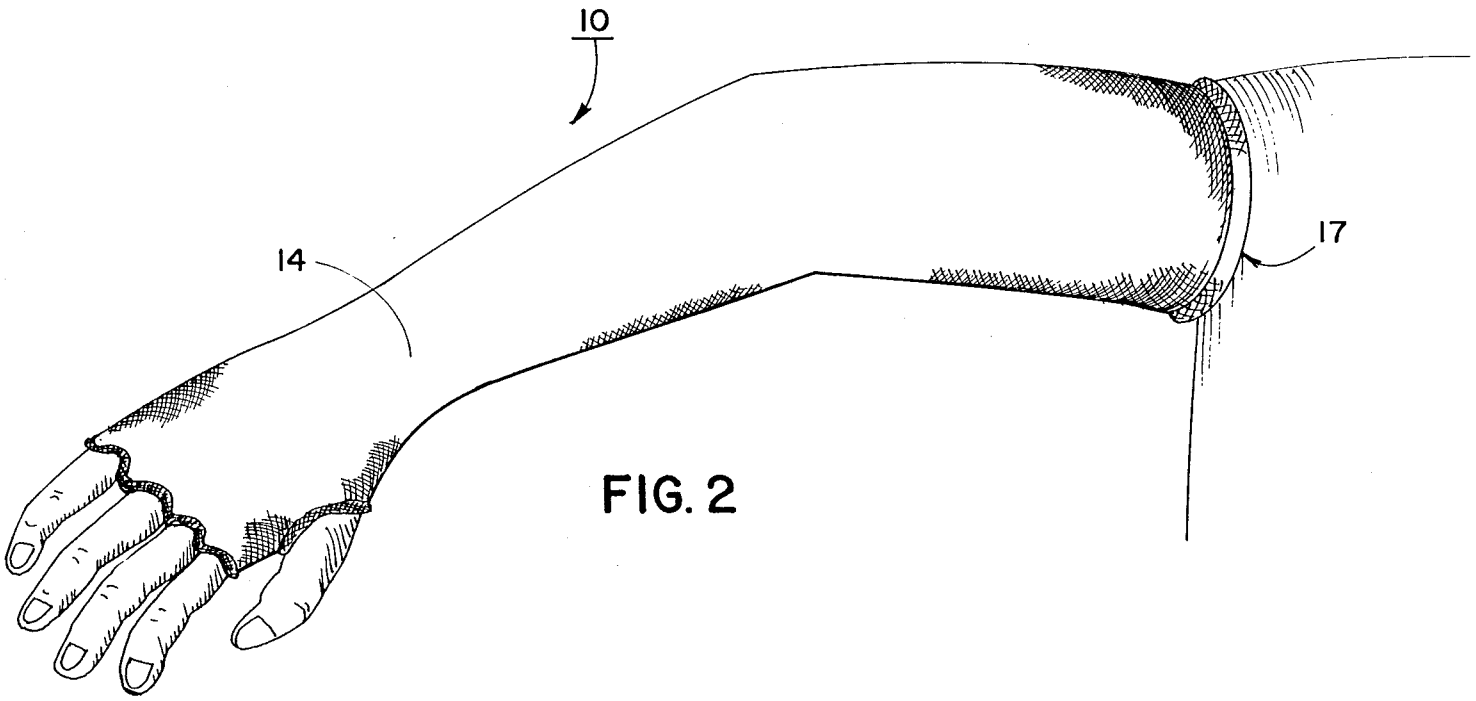
FIG. 2 illustrates the device of FIG. 1 in place on a typical wearer's arm.

Arm protector 10 is formed from a plurality of layers as illustrated in FIG. 3 and includes an outer layer 14 formed from a heat resistant metallic yarn such as conventionally available from various sources and sold under trademarks Kevlar, Nomex and others. Intermediate layer 15 is knitted from a conventional cotton yarn as is inner layer 16. Layers 14, 15 and 16, by being knitted will provide flexibility, and comfort to the wearer during use. Also the porous lightweight knitted structure of arm protector 10 will allow the arm to breathe and thus will allow the user to maintain the arm protector in place over the course of an eight (8) hour work shift without irritation, fatigue or discomfort. Layers 14, 15 and 16 are joined together at the proximal end 18 and at the distal end 19 of protector 10 as seen in FIG. 1. In use, arm protector 10 as shown in FIG. 2 is placed over the hand with the fingers extending therethrough, forearm and upper arm of the user and elastic band 17 maintains protector 10 in place during work. In the event the arm touches a heated pipe, manifold or other object, the metallic outer layer 14 will prevent the arm from being burned while the intermediate cotton layer 15 and inner layer 16 will provide absorption of perspiration. As would be understood, by using an all knitted structure arm protector 10 is flexible, lightweight and will conform to the arm while bending and turning at the wrist and elbow. Arm protector 10 is lightweight, weighing only a few ounces and can be worn on both arms during summer and winter without irritation or discomfort to the wearer.

Various sizes of arm protector 10 can be made as required although one particular size will fit several sizes due to the flexibility and inherent "stretch" of the knitted construction.

The illustrations and examples provided herein are for explanatory purposes and are not intended to limit the scope of the appended claims.

I claim:

1. An arm protector to prevent wearer contact with dangerous objects comprising: a flexible sleeve-like device for placement on the arm of the wearer, said device extending completely around the arm from the fingers to the shoulder of the wearer, said device having a proximal end, said proximal end being resilient to cling to the upper arm of the wearer, said device having a distal end, said distal end defining a plurality of finger openings, said sleeve-like device constructed of a plurality of knitted layers, an outer layer of said plurality of layers being formed from a metallic material and at least two layers, said inner layers formed from a non-metallic material, and said inner layers joined to said outer layer at said proximal and said distal ends.

2. An arm protector as claimed in claim 1 and including an intermediate layer, said intermediate layer disposed between said outer and said inner layers and joined to said outer and to said inner layer.

3. An arm protector as claimed in claim 2 wherein said intermediate layer is knitted from cotton yarn.

4. An arm protector as claimed in claim 1 wherein said inner layer is knitted from cotton yarn.

5. An arm protector as claimed in claim 1 wherein said outer layer is knitted from metallic yarn.

6. An arm protector as claimed in claim 1 wherein said sleeve-like device when worn extends from the fingers of the user to the top of the upper arm.

7. An arm protector as claimed in claim 1 wherein said sleeve-like device is flexible.

8. An arm protector as claimed in claim 1 wherein said proximal end of said device includes elastic yarn.

9. An arm protector as claimed in claim 1 wherein said metallic material comprises a metallic yarn.

10. An arm protector to prevent injury to a wearer comprising: a flexible sleeve-like device, said device having a proximal end, said proximal end including elastic yarn, said device having a distal end, said distal end defining a plurality of finger apertures, said sleeve-like device constructed from a plurality of knitted layers, said layers comprising: an outer, an intermediate and an inner layer, aid outer layer composed of metallic yarn, said inner and aid intermediate layers composed of cotton yarn, said inner, outer and intermediate layers joined together at the proximal end and the distal end whereby said metallic outer layer will prevent burns to the wearer when contacted by a heated object.

11. An arm protector as claimed in claim 10 wherein said proximal end includes an elastic band.

* * * * *